United States Patent [19]

Denpou et al.

[11] Patent Number: 4,537,041

[45] Date of Patent: Aug. 27, 1985

[54] REFRIGERATOR HAVING TEMPERATURE-RESPONSIVE CONTROL MEANS FOR COMBINED DIRECT AND FAN-COOLED OPERATION

[75] Inventors: Kazuo Denpou; Kazumi Eto, both of Ibaraki; Hideo Niida, Takatsuki, all of Japan

[73] Assignee: Kabushiki Kaisha Toshiba, Kawasaki, Japan

[21] Appl. No.: 597,751

[22] Filed: Apr. 6, 1984

[30] Foreign Application Priority Data

Jun. 22, 1983 [JP] Japan ..... 58-112342

[51] Int. Cl.[3] ..... F25B 5/00; F25D 21/06

[52] U.S. Cl. ..... 62/199; 62/276

[58] Field of Search ..... 62/200, 199, 198, 197, 62/205, 186, 276, 275, 283, 524, 525, 526

[56] References Cited

U.S. PATENT DOCUMENTS

| | | | |
|---|---|---|---|
| 2,126,285 | 8/1938 | Schaaf | 62/276 X |
| 2,245,053 | 6/1941 | Sanders, Jr. | 62/199 X |
| 2,442,188 | 5/1948 | Bauman | 62/526 X |
| 2,509,011 | 5/1950 | Moore | 62/526 X |
| 3,108,450 | 10/1963 | Crotser | 62/199 X |
| 4,270,364 | 6/1981 | Oonishi et al. | 62/198 |
| 4,389,854 | 6/1983 | Ogita et al. | 62/198 |
| 4,439,998 | 4/1984 | Horvay et al. | 62/200 |

FOREIGN PATENT DOCUMENTS

| | | |
|---|---|---|
| 50-96963 | 8/1975 | Japan . |
| 50-148963 | 11/1975 | Japan . |

*Primary Examiner*—Harry Tanner

*Attorney, Agent, or Firm*—Schwartz, Jeffery, Schwaab, Mack, Blumenthal & Evans

[57] ABSTRACT

A refrigerator with a freezing chamber and a cold chamber, wherein the freezing chamber is cooled rapidly by a main, fan-type, cooling system and a secondary, direct-type, cooling system. The secondary cooling system includes a box-like cooler having a projecting plate for placing food products thereon to provide uniform cooling within the freezing chamber. The refrigerator compressor is controlled in accordance with the temperature of the freezing chamber so as to be efficiently operated in the freezing cycle. Gas coolant is directed via control valves in accordance with the temperature of the freezing and cold chambers.

16 Claims, 6 Drawing Figures

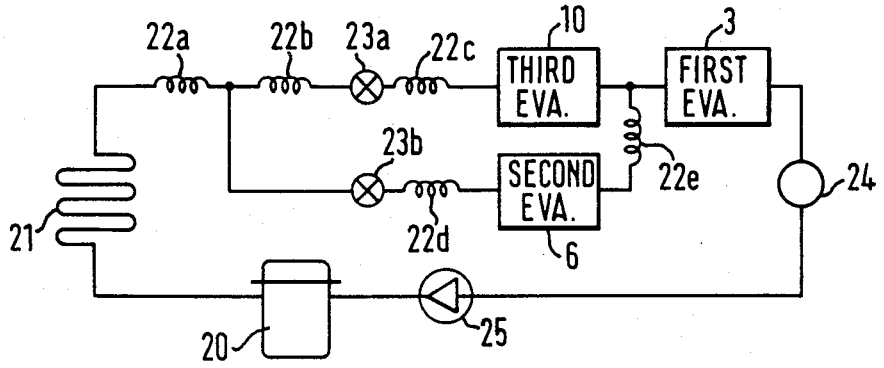
FIG. 2
FIG. 3
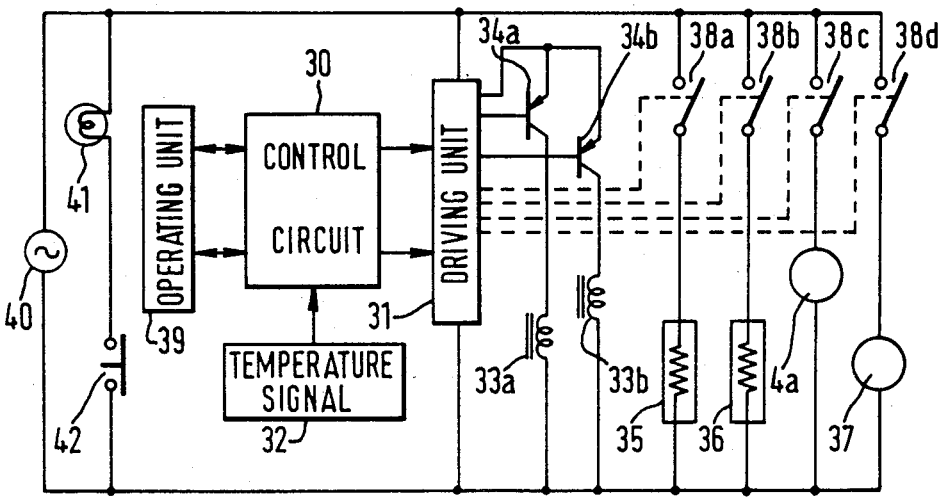

REFRIGERATOR HAVING TEMPERATURE-RESPONSIVE CONTROL MEANS FOR COMBINED DIRECT AND FAN-COOLED OPERATION

BACKGROUND OF THE INVENTION

This invention relates to a refrigerator for storage of food products at low temperature, and more particularly to a temperature circuit for operation of a freezing chamber and a cold chamber thereof.

There are two basic types of conventional freezing refrigerators. The direct-cooling-type refrigerator uses an inner space of a box-like cooler for a freezing chamber with an evaporator positioned adjacent the walls thereof. The fan-type cooling refrigerator has a fan which circulates cold air to both the freezing chamber and the cold chamber. Such conventional refrigerators are described, for example, in Japanese Patent Disclosures Nos. 50-96963 and 50-148963. The two types each have advantages and disadvantages. In the direct-cooling-type refrigerator, food products on a bottom plate of the freezing chamber can be cooled rapidly. However, it takes a long time to cool food products stored above the bottom plate in the freezing chamber. In the fan-type cooling refrigerator, food products are more rapidly cooled in the regions off of the bottom plate of the freezer than those in contact with the bottom plate, as the latter products are often blocked from the circulating air currents. Accordingly, food products in both types of refrigerators are not cooled equivalently, and each type suffers from freezing cycle inefficiencies.

SUMMARY OF THE INVENTION

It is a primary object of the present invention to provide a freezing refrigerator which is able to cool food products equivalently and rapidly, regardless of their position within a freezing chamber of the refrigerator.

It is another object of the invention to provide a means for controlling the temperature of both the freezing and cold chambers of the refrigerator and which is operated efficiently in the freezing cycle.

According to the invention, the freezing refrigerator has a freezing chamber and a cold chamber for storage of food products at low temperature. The freezing chamber is cooled by a main cooling system and a secondary cooling system. The main cooling system comprises a first evaporator and a fan. The secondary cooling system comprises a second evaporator positioned adjacent the walls of the box-like cooler for direct cooling thereof. The refrigerator further has a cold chamber which is cooled by cold air from a third cooling system comprising a third evaporator.

The refrigerator compressor is controlled according to the temperature of the freezing chamber. The gas coolant provided to the evaporator is controlled by control valves in response to temperature of the cold chamber.

BRIEF DESCRIPTION OF THE DRAWINGS

Features of the present invention will be apparent from the following drawings, wherein:

FIG. 2 is a schematic diagram showing a freezing cycle in accordance with the invention;

FIG. 3 is a circuit diagram showing a circuit configuration for controlling the freezing cycle in accordance with the invention;

DETAILED DESCRIPTION OF THE PREFERREED EMBODIMENTS

Figure 1:
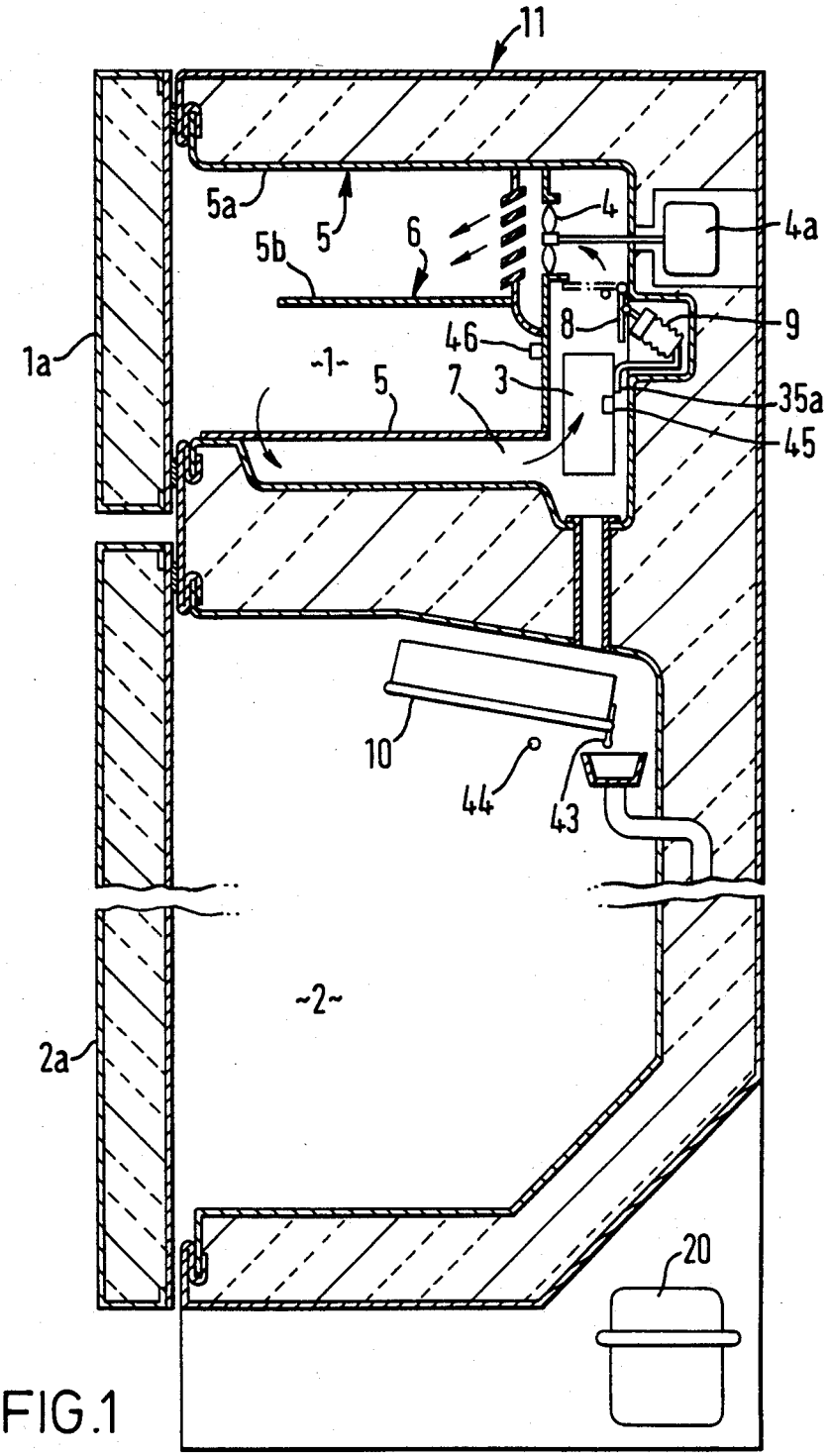
FIG. 1 is a cross-sectional view of an embodiment of a refrigerator in accordance with the invention showing a freezing chamber and a cold chamber thereof.

Referring to the drawings, a freezing refrigerator shown in FIG. 1 has a freezing chamber 1 and a cold chamber 2 for storage of food products at low temperature. Freezing chamber 1 includes a main cooler system and a secondary cooler system. The main cooler system comprises a first evaporator 3 and a fan 4. The secondary cooler system comprises a box-like cooler 5 made of plates 5*a* cooled by a second evaporator 6 disposed adjacent to the plates 5*a* (not shown). A main, fan-cooling, and secondary, direct-cooling, system of this type is shown, for example, in Japanese Patent publication No. 50-96963. In FIG. 1, a projecting plate 5*b* is fixed horizontally in the freezing chamber to serve as a shelf to thus permit food products to be placed thereon. Plate 5*b* also may include portions of the coil of the evaporator 6 disposed therein. The first evaporator 3 is disposed in an air passageway 7 which is formed around the box-like cooler 5. The air passageway 7 is connected with the freezing chamber 1 to cool it by means of the evaporator 3 and fan 4. The fan 4 is moved by a fan motor 4*a* and is separated from the evaporator 3 by a damper 8. A bellows 9 moves damper 8 according to the temperature of the first evaporator 3.

The cold chamber 2 includes a third evaporator or cooler 10 at the upper side thereof. A first door 1*a* and a second door 2*a* are hinged on the front side of an outer box 11 to close the freezing chamber 1 and the cold chamber 2, respectively.

A freezing cycle of the refrigerator is described with reference to FIG. 2. A compressor 20 is connected to the third evaporator 10 for the cold chamber 2 through a condenser 21, capillary tubes 22*a*, 22*b*, and 22*c*, and a first control valve 23*a*. The compressor 20 is also connected to the second evaporator 6 for the freezing chamber 1, through the condenser 21, capillary tubes 22*a* and 22*d*, and a second control valve 23*b*. As shown in the figure, the control valve 23*b* and the capillary tube 22*d* are inserted between the outlet of the capillary tube 22*a* and the second evaporator 6.

The outlet of third evaporator 10 is connected to the first evaporator 3. The first evaporator 3 is connected to the compressor 20 through an accumulator 24, and a check valve 25. The outlet of second evaporator 6 is connected to the inlet of first evaporator 3 through a capillary tube 22*e*. The components shown in FIG. 2 are well known in the art, and thus details are omitted for simplicity of description of the invention.

In FIG. 3, a control circuit 30 controls a driving unit 31 according to a temperature-detecting unit 32 to drive respective relays 33*a*, 33*b* for the first and second control valves 23*a*, 23*b* through transistors 34*a*, 34*b*. The driving unit 31 further drives a defrosting heater 35, a damper-driving heater 36, fan motor 4*a*, and a compressor motor 37 through switches 38*a*, 38*b*, 38*c*, and 38*d*, respectively. The defrosting heater 35 is installed on the first evaporator 3. The damper-driving heater 36 causes damper 8 to close passageway 7 by heating a thermal responsive element at point 35*a* associated with the bellows 9. The control circuit 30 is connected with an operating and displaying unit 39 and power source 40. A lamp 41 is connected with the power source 40 through a door switch 42.

Figure 4:
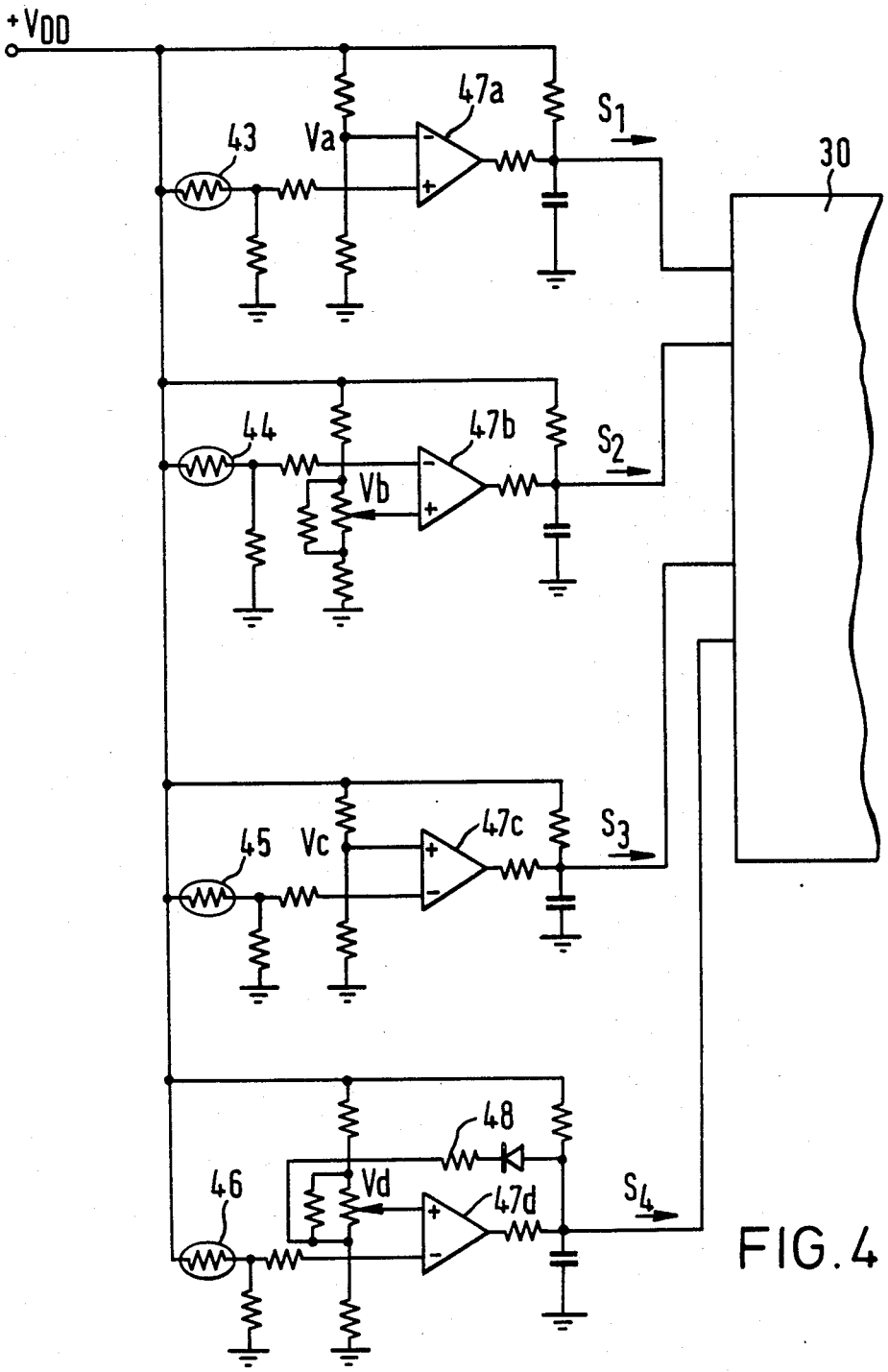
FIG. 4 is a circuit diagram showing a circuit configuration of the temperature-detecting unit of FIG. 3.

FIG. 4 shows a specific exemplary circuit of the temperature-detecting unit 32. The unit 32 has temperature-detecting components 43, 44, 45, and 46, respectively, for the third evaporator 10, cold chamber 2, first evaporator 3, and freezing chamber 1. The components 43, 44, 45, and 46, respectively, provide temperature signals $S_1$, $S_2$, $S_3$, and $S_4$ to control circuit 30 through comparators 47*a*, 47*b*, 47*c*, and 47*d*.

In FIG. 4, $V_{DD}$ is a power voltage supply, and power voltages Va, Vb, Vc, and Vd are set to predetermined values. The comparator 47*d* produces a freezing chamber temperature signal $S_4$ that exhibits a particular hysteresis owing to resistor 48 connected with comparator 47*d*. Therefore, since the rate of increase of the temperature signal $S_4$ is different from its rate of decrease, the starting temperature of compressor 20 is different from its stopping temperature when compressor 20 starts to move after being turned off.

Figure 5:
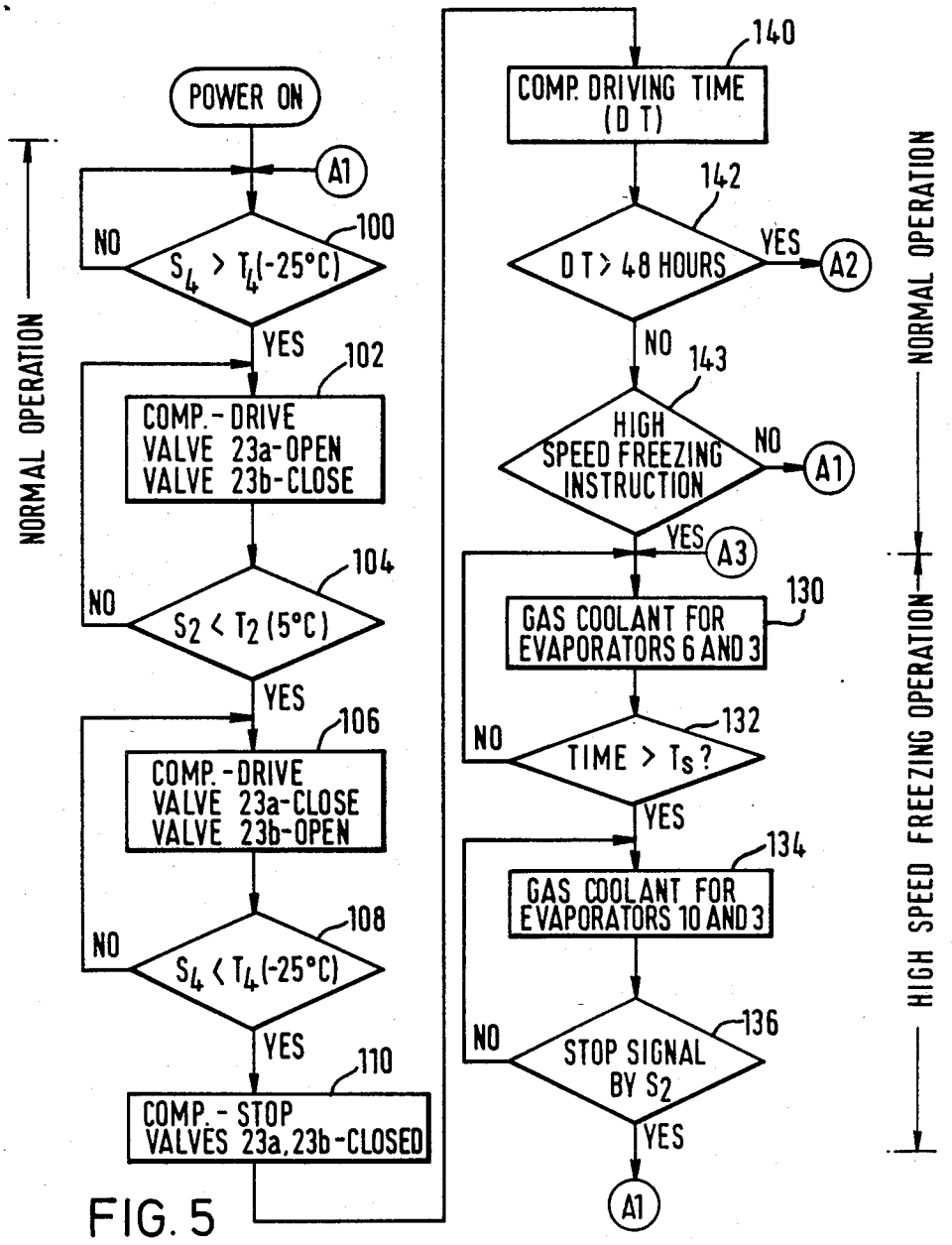
FIG. 5 is a flowchart showing the operation of the freezing refrigerator in the normal mode of operation and in the high-speed freezing mode of operation.
Figure 6:
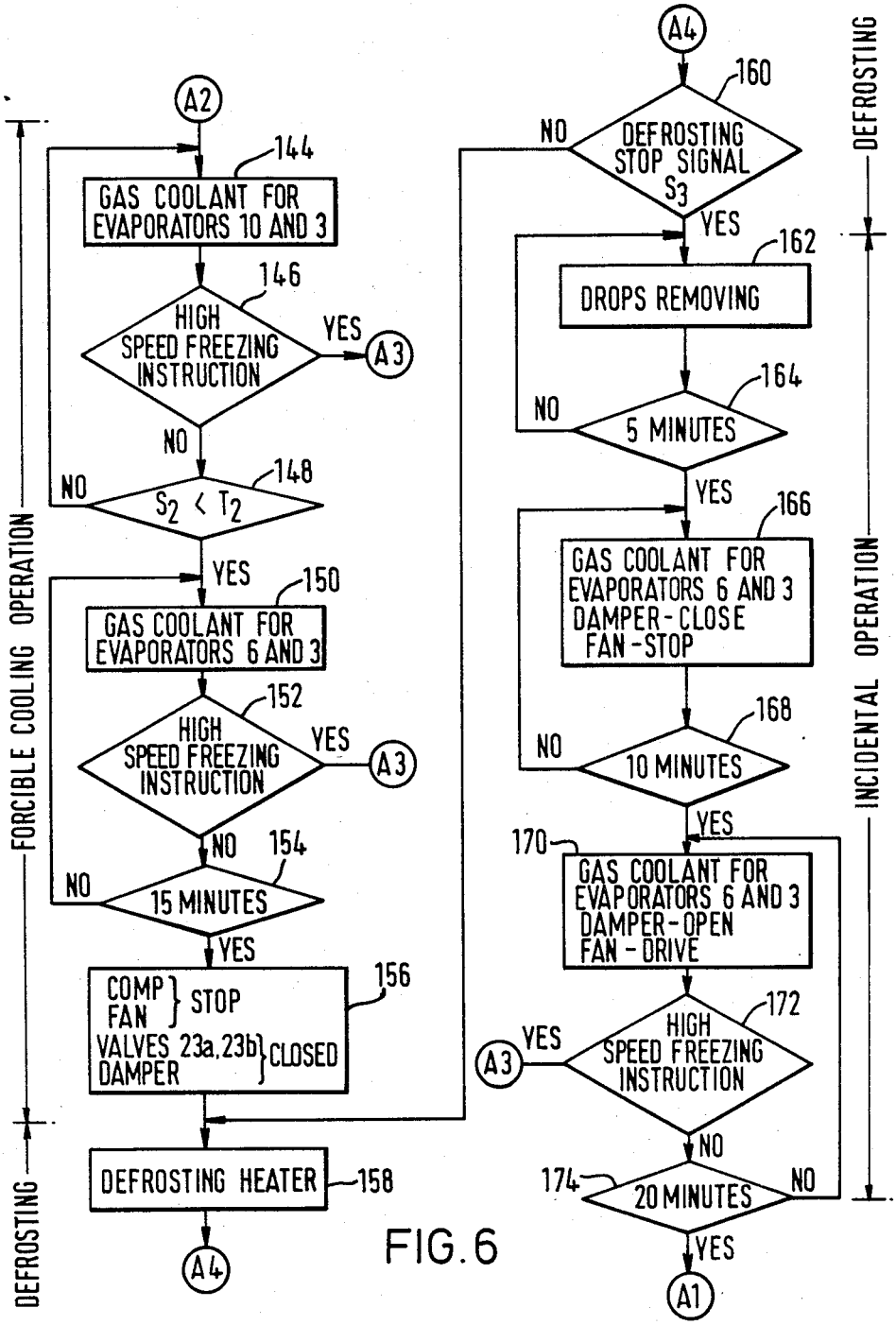
FIG. 6 is a flowchart showing the operation of the freezing refrigerator in the defrost operation mode of operation.

Operation of the refrigerator will be described hereinafter with reference to FIGS. 5 and 6. Inasmuch as the control circuit 30 may take the form of programmable logic elements or even a microprocessor, the following flowchart description will be exemplary of the logic flow therethrough.

(1) Normal Operation

When both the temperatures of the freezing chamber 1 and the cold chamber 2 are, respectively, over predetermined set temperatures $T_4$, $T_2$, control circuit 30 detects this condition (steps 100 and 104) by cold chamber temperature signal $S_2$, and freezing chamber temperature signal $S_4$ of temperature-detecting unit 32, and drives compressor 20 through compressor motor 37 (step 102). Fan motor 4*a* is connected with a power source through switch 38*a* to operate fan 4. First control valve 23*a* is opened, and second control valve 23*b* is closed (step 102). In this case, the freezing cycle continues to be maintained in normal operation. Condenser 21 liquifies the gas coolant of compressor 20.

Gas coolant is supplied to third evaporator 10 and first evaporator 3 through capillary tubes 22*a*, 22*b*, and 22*c* and first control valve 23*a* to respectively cool cold chamber 2 and freezing chamber 1. Cold chamber 2 is cooled by third evaporator 10, and freezing chamber 1 is cooled by circulation of cool air from the first evaporator 3 through the fan 4, damper 8 being in the open position.

If the temperature of cold chamber 2 is lower than the predetermined temperature $T_2$, such as, for example, 5° C. (step 104), first control valve 23*a* is closed, and second control valve 23*b* is opened (step 106) to redirect the flow of gas coolant from the third and first evaporators 10 and 3 to the second and first evaporators 6 and 3. In this normal freezer-only mode of operation, if the temperature of freezing chamber 1, as represented by the temperature signal $S_4$ becomes lower than the predetermined temperature $T_4$, such as, for example, −25° C. (step 108), compressor 20 is cut off via switch 38*d*. When the compressor 20 is turned off, both first and second control valves 23*a* and 23*b* are closed (step 110).

Since valves 23*a* and 23*b* are closed, they prevent gas coolant from leaking out to the evaporators 10, 3, and 6 where it would otherwise be heated. The coolant stays in condenser 21 at relatively high temperature and high pressure. When compressor 20 is restarted, it can operate in a highly efficient manner because of its retaining the gas coolant at high pressure in the condenser 21. If the temperature signal $S_4$ of the freezing chamber 1 corresponds to a temperature which is again higher than the predetermined temperature $T_4$, compressor 20 starts to operate again (step 100 from branch A1 in FIG. 5).

(2) Defrost Cycle for Cold Chamber 2

When the gas coolant is operated through the third evaporator 10 for a long period of time, for example, 10 hours, it is necessary to defrost evaporator 10 to permit more efficient operation thereof. For this purpose, the valve 23*a* is closed to stop the supply of gas coolant for the third evaporator 10, and the second valve 23*b* is opened. Evaporator 10 may now defrost, while the freezer can continue to be maintained cold. (The defrost cycle for cold chamber 2 is not illustrated in the flowcharts).

(3) Maintaining Temperature of Cold Chamber 2

When compressor 20 has been stopped for over thirty minutes, the temperature of third evaporator 10 may rise to a cooling start temperature, for example, such as 5° C. In this case, compressor motor 37 is restarted in response to signal $S_1$. (This operation is not illustrated in the flowcharts).

(4) High-Speed Freezing Operation

Operating unit 39 contains a manually actuatable switch which may be used by the operator to provide a jump to branch A3, step 130, in the event a high-speed freezing operation is desired. Such an operation may be desired, for example, when a large and/or warm object is placed in the freezer and there is a need to provide extra fast freezing thereof. The A3 branch to step 130 may occur at several places in the flowchart where the instruction is examined, for example, at steps 143, 146, 152, and 172.

In the high-speed freezing operation, first control valve 23*a* is closed, and second control valve 23*b* is opened (step 130) to provide gas coolant for second evaporator 6 and first evaporator 3. Compressor 20 operated to rapidly cool freezing chamber 1 for a predetermined time $T_s$. The time period $T_s$ may be manually adjusted. When the predetermined time is over (step 132), first valve 23*a* is opened and second valve 23*b* is again closed (step 134). This condition continues until the cold chamber temperature signal $S_2$ produces a cooling stop signal through temperature-detecting component 44 (step 136). Thus, cold chamber 2 is maintain at a desired temperature during the high-speed freezing operation of freezing chamber 1.

(5) Defrost Operation

The defrost operation has two components associated with the defrost operation per se, namely, (the so-called forced-cooling operation and the incidental operation. The forced-cooling operation takes place before defrosting and the incidental operation takes place after defrosting. When compressor 20 continues to move, for example, for 48 hours, (steps 140 and 142), control circuit 30 produces a defrost-starting signal to operate the forced-cooling operation (program branch A2). As used herein, the term "forced-cooling" implies cooling which is initiated as a result of something other than a temperture condition.

(A) Forced Cooling Operation Before Defrosting

In accordance with the defrost-starting signal, compressor 20 and fan motor 4*a* are energized, and first control valve 23*a* is opened to provide gas coolant for third and first evaporators 10 and 3 (step 144). Cold chamber 2 continues to be cooled forcibly until closing of the first valve 23*a* by temperature signal $S_2$ (steps 144 through 148). When first valve 23*a* is closed, and second valve 23*b* is opened by temperature signal $S_2$, gas coolant is forcibly provided for second and first evaporators 6 and 3 for a predetermined time, for example, such as fifteen minutes (steps 150 through 154). If the predetermined time has passed, compressor 20 is stopped, both first and second valves 23*a* and 23*b* are closed, and damper 8 is also closed (step 156). Damper 8 is closed by the expansive force of bellows 9 through the damper-driving heater 36.

Closure of the damper 8 serves to substantially isolate the vapor in air passageway 7 from freezing chamber 1 and to prevent freezing of the vapor at the surfaces adjacent evaporator 6, a problem which would otherwise occur due to convection currents caused by the difference in temperature between evaporator 3 and freezer 1.

After closing of damper 8 in step 156, first evaporator 3 starts to defrost by supplying electric power to the defrosting heater 35 (step 158). Then, the defrost operation is completed according to whether the temperature signal $S_3$ exceeds a predetermined value $T_3$. The signal $S_3$ thus serves as a defrosting stop signal (step 160). As the frost adhering to first evaporator 3 melts, the surface temperature of the evaporator 3 becomes rapidly high. Control circuit 30 monitors the temperature signal $S_3$ via temperature-detecting component 45 and cuts off the electricity supply from defrosting heater 35 when the temperature $T_3$ is exceeded, thus moving to the incidental mode of operation.

(B) Incidental Operation after Defrosting

The incidental operation includes three steps: the so-called drop-removal operation, heat-removal operation and a forced-cooling operation.

In the drop-removal operation, compressor 20 continues to be turned off for several minutes (five minutes) while the damper 8 is closed (steps 162 and 164). At this time, moisture droplets on the first evaporator 3 are formed from the frost and these droplets fall off the evaporator and are collected.

The forced-cooling operation is then started. Compressor 20 is forcibly turned on, while second control valve 236 is opened to provide gas coolant for second and first evaporators 6 and 3 (step 166). This operation continues for a while (ten minutes) to cool the evaporator 3 for absorbing the remaining heat from the defrosting operation (step 168). Damper 8 continues to be closed, and fan motor 4*a* does not move. Thus, the remaining heat from the defrosting operation is not driven from air passageway 7 into freezing chamber 1.

Damper 8 is then opened, and fan motor 4*a* is energized when gas coolant is provided forcibly for the second and first evaporators 6 and 3 for about twenty minutes (steps 170–174). As a result, freezing chamber 1 is rapidly cooled. After that, cooling is controlled according to the temperature signal $S_4$ in a normal operation (branch to A1 after step 174).

(6) Priority of High-Speed Freezing and Defrosting

The high-speed freezing instruction may be given at any time by the operator, but it is only examined in the logic flow at selected steps, e.g., 143, 146, 152, and 172. Thus, during the defrosting operation of steps 158 and 160, and during the drop- and heat-removal operations of steps 162–168, a high-speed freezing instruction is ignored, thereby giving priority to the identical steps of the defrost cycle. In the forced-cooling operations of steps 144–154 and 170–174, the high-speed freezing operation takes priority over the overall defrost operation of FIG. 6, thereby forcing a branch at A3 to step 130.

As is clear from the above description, the refrigerator according to the invention has a projecting plate which houses part of a secondary evaporator in the freezing chamber. Accordingly, food products on the projecting plate are cooled rapidly by the secondary evaporator. Further, food products in the freezing chamber are cooled by cold air through the fan and the first evaporator.

In the freezing cycle, the compressor is controlled according to the temperature of the freezing chamber, and the first and third evaporators are controlled by the control valves according to the temperature of the cold chamber. Therefore, the compressor may be efficiently operated, since gas coolant is able to maintain its energy.

In addition, when circulating cold air only in the freezing chamber, frost does not readily occur on the first evaporator. Accordingly, it is not necessary to provide a defrosting operation as frequently as in conventional systems.

While the invention has been described in reference to preferred embodiments, it will be understood by those skilled in the art that various modifications may be made without departing from the spirit and scope of the invention as set forth in the appended claims.

What is claimed is:

1. A refrigerator having a freezing chamber and a cold chamber comprising:

a main cooling means, including a first evaporator and a fan, for cooling the freezing chamber;

a secondary cooling means, including a second evaporator positioned adjacent said freezing chamber for direct cooling thereof;

a third cooling means, including a third evaporator disposed in said cold chamber for cooling thereof;

a compressor for providing gas coolant for the first, second and third evaporators;

a first control valve for directing gas coolant to the third and first evaporators;

a second control valve for directing gas coolant to the second and first evaporators;

first means for detecting the temperature of the freezing chamber and for controlling the compressor according to the detected temperature thereof; and second means for detecting the temperature of the cold chamber and for controlling the first and second control valves in accordance therewith.

2. A refrigerator as recited in claim 1, wherein said freezing chamber is in the form of a box-like cooler having a projecting plate serving, in part, as a shelf for food.

3. A refrigerator as recited in claim 1 further comprising an air passageway disposed around said freezing chamber, and wherein said first evaporator and said fan are disposed in said air passageway.

4. A refrigerator as recited in claim 3 further comprising a damper provided in said air passageway for preventing airflow therethrough.

5. A refrigerator as recited in claim 1 wherein the first and second control valves are closed in response to said first means when said first means operates to deactivate said compressor.

6. A refrigerator as recited in claim 1 further including means for closing said first control valve if said compressor has been operating for more than a predetermined time.

7. A refrigerator as recited in claim 1 further comprising means for forcibly moving said compressor to cool said cold chamber according to the temperature of the third evaporator when said cold chamber has been at a higher temperature than a predetermined temperature for about thirty minutes, during which said compressor has been stopped.

8. A refrigerator as recited in claim 3 further comprising a defrosting heater provided on said first evaporator.

9. A refrigerator as recited in claim 8 further comprising a damper within said air passageway, said damper being closed to substantially isolate said air passageway from said freezing chamber when the defrosting heater is turned on.

10. A refrigerator having a freezing chamber and a cold chamber comprising:

a main cooling means including a first evaporator and a fan, for cooling the freezing chamber;

a secondary cooling means including a second evaporator positioned adjacent said freezing chamber for direct cooling thereof;

a third cooling means including a third evaporator ' disposed in said cold chamber for cooling thereof;

a compressor for providing refrigerant to said evaporators;

control valve means including a first valve for directing refrigerant to said first and third evaporators and a second valve for directing refrigerant to said first and second evaporators;

temperature-sensing means for sensing the temperatures of said freezing chamber and cold chamber; and control means responsive to said sensed temperature for operating said control valve means in response thereto.

11. A refrigerator as recited in claim 10, wherein said freezing chamber contains a projecting shelf spacedly positioned from top and bottom portions of said freezing chamber.

12. A refrigerator as recited in claim 11, wherein said shelf includes a portion of said second evaporator.

13. A refrigerator as recited in claim 10, wherein said control means includes a microcomputer.

14. A refrigerator as recited in claim 10 further comprising a manually operable high-speed freezing switch, and said control means operates in response to said switch for operating said control valves to direct refrigerant to said first and second evaporators.

15. A refrigerator as recited in claim 10, wherein said first evaporator further includes a heater, and said control means operates said heater in defrosting said first evaporator.

16. A refrigerator as recited in claim 10 further including an air passageway disposed around said freezing chamber and a damper disposed therein, said first evaporator and said fan being disposed within said air passageway and said damper adapted to be closed for substantially isolating said air passageway from said freezing chamber.

* * * * *